US006422974B1

(12) United States Patent
Schimmel

(10) Patent No.: US 6,422,974 B1
(45) Date of Patent: Jul. 23, 2002

(54) ELASTOMERIC HAND EXERCISER WRITING IMPLEMENT AND AMUSEMENT DEVICE

(75) Inventor: Aaron Schimmel, Chicago, IL (US)

(73) Assignee: Option Products, Inc., Niles, IL (US)

( * ) Notice: Subject to any disclaimer, the term of this patent is extended or adjusted under 35 U.S.C. 154(b) by 0 days.

(21) Appl. No.: 09/459,669

(22) Filed: Dec. 13, 1999

(51) Int. Cl.[7] ..... A63B 23/14; A63B 23/16

(52) U.S. Cl. ..... 482/44; D19/56; 446/15; D21/61

(58) Field of Search ..... 482/44; D19/56, D19/35, 81, 42, 98; 446/15–21, 24; D21/61

(56) References Cited

U.S. PATENT DOCUMENTS

D35,466 S * 12/1901 Saettele
D57,520 S * 4/1921 Fortune
D61,041 S * 6/1922 Jones
1,655,365 A * 1/1928 Gurtov
D248,028 S * 5/1978 Huffman
D252,757 S * 8/1979 Sublete
D277,296 S * 1/1985 Frazier
4,728,212 A * 3/1988 Spector ..... 401/88
D298,263 S * 10/1988 Perry
D333,165 S * 2/1993 Neuroth et al. ..... D21/61
D356,113 S * 3/1995 Maggio ..... D19/36

* cited by examiner

*Primary Examiner*—Mickey Yu
*Assistant Examiner*—Lou Bala Amerson
(74) *Attorney, Agent, or Firm*—Leydig, Voit & Mayer, Ltd.

(57) ABSTRACT

A writing implement that includes an elastomeric hand exerciser object and integral amusement device. The elastomeric exerciser, preferably a shaped ball, has a diameter that allows the ball to fit between fingers and a palm of a closed hand of a user such that manual gripping and releasing of the ball exercises hand, finger and forearm muscles/ligaments of the user and thereby diminishes repetitive stress states of muscles/ligaments of the hand, fingers and forearm. The shaped ball is secured to one end of a transparent barrel that has a writing implement secured to the other end. An amusement device is positioned within the transparent barrel.

3 Claims, 4 Drawing Sheets

Fig. 1
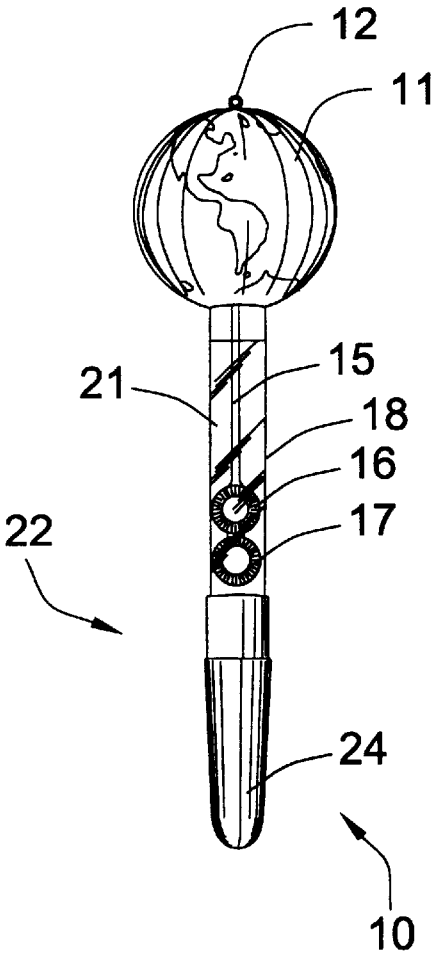
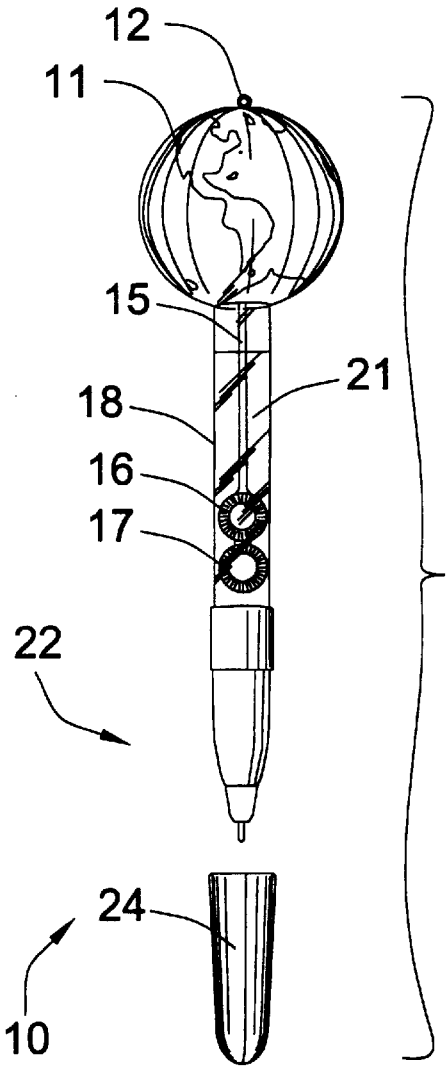
Fig. 2

Fig. 4
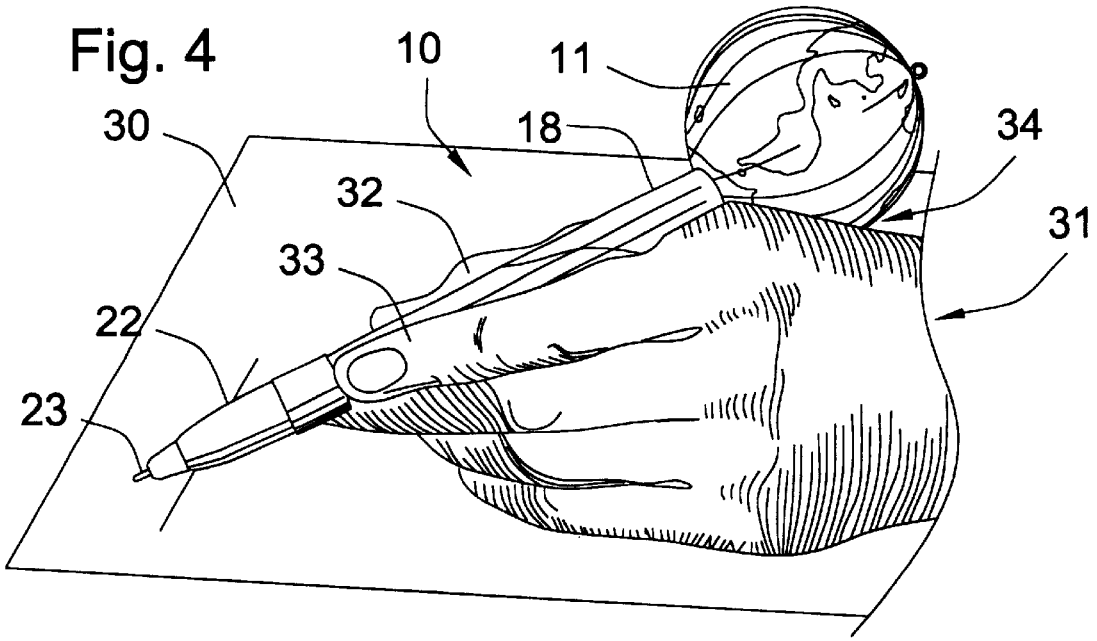
Fig. 5
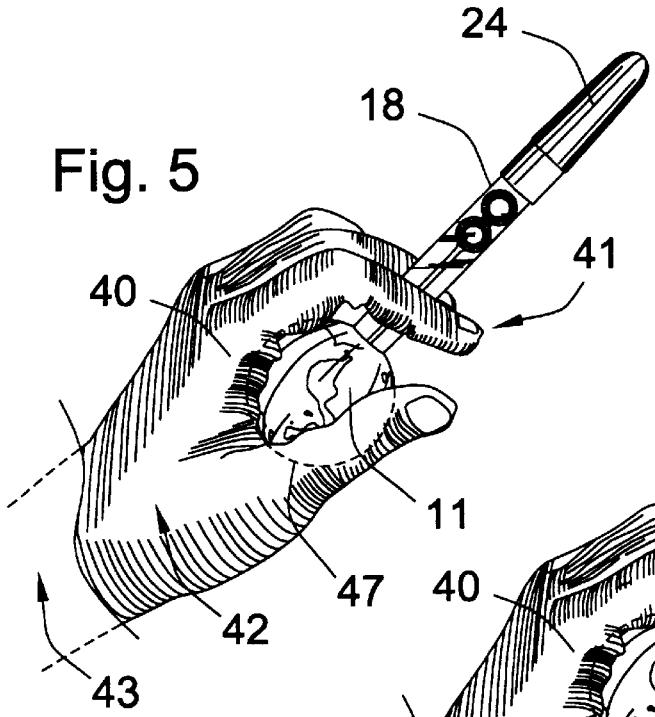
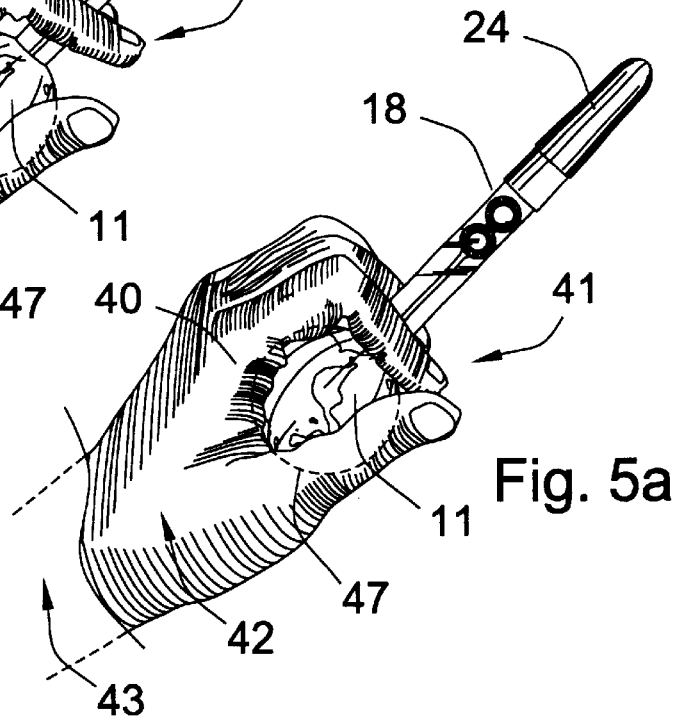
Fig. 5a

ELASTOMERIC HAND EXERCISER WRITING IMPLEMENT AND AMUSEMENT DEVICE

FIELD OF THE INVENTION

A hand exerciser writing implement and more specifically an elastomeric hand exercise shaped object writing implement and amusement device.

BACKGROUND OF THE INVENTION

The current increased use of manual data entry into word processors and computer systems by means of manual manipulation of keys on a keyboard is putting literally millions of individuals in front of keyboards on a daily basis. A by product of this activity is a physical malady described as repetitive motion injury. More specifically, when hand, finger, wrist and forearm are involved it is commonly called carpal tunnel syndrome. The syndrome is so named because of a narrow channel in the wrist called the carpal tunnel which includes soft tissue which when strained by repetitive motions, results in carpal tunnel syndrome (CTS).

The repetitive motions that cause CTS range from some types of factory work, long hours operating a computer keyboard to playing a musical instrument to name a few. Long hours before a computer terminal operating a keyboard not only lead to CTS but boredom. Physical exercise of the finger and forearm muscles through ranges of motion and physical stretching have provided for many a modicum of relief from the pain that attends CTS. Manual manipulation of an elastomeric i.e. rubber ball has proved beneficial to many a CTS sufferer. The task of keeping a freely rolling rubber ball in ones work area has proved vexing to many who find the ball always on the roll when stored on a desk top adjacent the computer. Putting the exercise ball in a drawer contains its random rolling movement but removes it from the computer operators sight. The old adage out of sight out of mind comes into play when the exercise ball remains hidden in a drawer. While many individuals are aware and consciously acknowledge that physical exercise is a healthy thing to do, subconsciously it seems that the effort such exercise requires tends to reduce the motivation to do what is good for the individual, namely exercise. Those people that are willing to begin an exercise regime often find the very repetitive nature of the exercise is as boring as the data entry work they may be doing. Even though a computer operator may spend endless hours at a computer terminal it would be rare to find such an operator without a writing implement of some kind next to the keyboard.

It is to the just described need for exercise and relief from boredom that the instant invention provides answer.

The boredom of many desk jobs has been ameliorated by inclusion of toys that are combined with a pen. The Hsiung, et al., U.S. Pat. No. 5,281,039 ('039) issued Jan. 25, 1994 is a good example. The '039 patent is directed to a pen that includes in a transparent barrel of the pen a toy labyrinth that includes a ball that makes its way through the labyrinth from a start to a finish by means of the pen holder tilting and turning the barrel to get the ball to move through the labyrinth. The U.S. Pat. No. 5,083,81 ('881) to Yoshinaga issued Jan. 28, 1992 provides another example of a pen that includes a decorative flower petal like article a top a writing tool, namely a ball point pen. The owner of such a pen can entertain themselves by manually causing the flower petal and decorative article to open and close its petals to reveal a butterfly-shaped accessory.

While both of the aforementioned patents when manually manipulated do provide a diversion from the routine of work and arguably induce relaxation and some amusement to the pen user there is only minimal to no exercise afforded the fingers, hand and forearm muscles of the user.

In contradistinction to the '039 and '881 patents the subject invention not only allows its user to write, exercise hand, finger and forearm muscles but amuse themselves in a most delightful way.

SUMMARY OF THE INVENTION

The invention is directed to a writing implement that includes an elastomeric hand exerciser and an amusement device. Preferably, the exerciser is ball-shaped. An elastomeric shaped object having a dimensional configuration that allows it to fit between fingers and a palm of a closed hand of a user permits manual griping and releasing of the object to exercise hand, finger and forearm muscle/ligaments of the user and thereby diminishes repetitive stress states of the muscles/ligaments of the hand and forearm. The exerciser object is secured to one end of a transparent barrel that has a writing implement secured to the other end. An amusement device is positioned within the transparent barrel.

It is therefore a primary object of the invention to provide a writing implement that doubles as a hand, finger and forearm exercise and amusement device.

Another object of the invention is to provide a shaped hand exercise device integrally coupled to a writing implement that provides a non-rollaway hand exerciser.

Yet another object of the invention is to provide a hand exerciser writing implement that includes within a transparent barrel thereof a bubble blowing apparatus.

Still yet another object of the invention is to provide a hand exerciser writing implement that when employed as a writing implement provides a natural support for the exerciser upon an upper surface of the users writing hand at a point on the hand where the thumb and index finger of the user join the hand.

Still yet another object of the invention is to provide a hand exerciser writing implement that is provided with a transparent barrel filled with a bubble making solution position between the writing implement and the hand exerciser wherein the hand exercise object carries a bubble wand that is stored within the barrel and object. The wand and barrel are adapted to be separated from each other to permit the wand to be employed in bubble production.

In the attainment of the foregoing objects the invention contemplates as falling within the purview of the claims an elastomeric hand exerciser object writing implement and amusement device that includes an elastomeric shaped object that has a dimensional configuration that allows the object to fit between fingers and a palm of a partially closed hand of a user such that manually gripping and releasing of the object by a user therapeutically exercises hand, fingers and forearm muscles/ligaments to thereby diminish stress states in the muscles/ligaments of the hand, fingers and forearm. The object has an elongated transparent barrel secured thereto at one end thereof. The transparent barrel has visibly present therein an amusement device. A writing implement is integrally secured to another end of the barrel. The overall length of the object, barrel and writing implement is such that when the writing implement is grasped by the fingers and hand of the user preparatory to writing, a portion of the barrel and all of the integrally secured exercise object rest upon an upper surface of the users hand at a point on the hand where the thumb and index finger join the hand to thereby provide support and balance for the object by the hand of the user. This balanced state facilitates the application of thumb and index finger pressure that grip the writing implement during writing activity brought about by movement of the writing implement by the fingers and hand of the user.

Other objects and advantages of the invention will become more apparent from the following detailed description when taken in conjunction with the accompanying drawings.

BRIEF DESCRIPTION OF THE DRAWINGS

FIG. 1 is a perspective view of an elastomeric hand exerciser writing implement and amusement device embodying the invention.

FIG. 2 is a partially exploded view of the invention depicted in FIG. 1.

FIG. 4 is a perspective view of the invention in its writing mode of use.

FIGS. 5 and 5*a* are perspective views of the invention in hand, finger, forearm exercise modes of use.

While the invention will be described with a specific embodiment, there is no intent to limit it to that embodiment. On the contrary, the intent is to cover all alternatives, modifications and equivalents as included within the spirit and scope of the invention as defined by the appended claims.

DETAILED DESCRIPTION OF THE PREFERRED EMBODIMENTS

Figure 3:
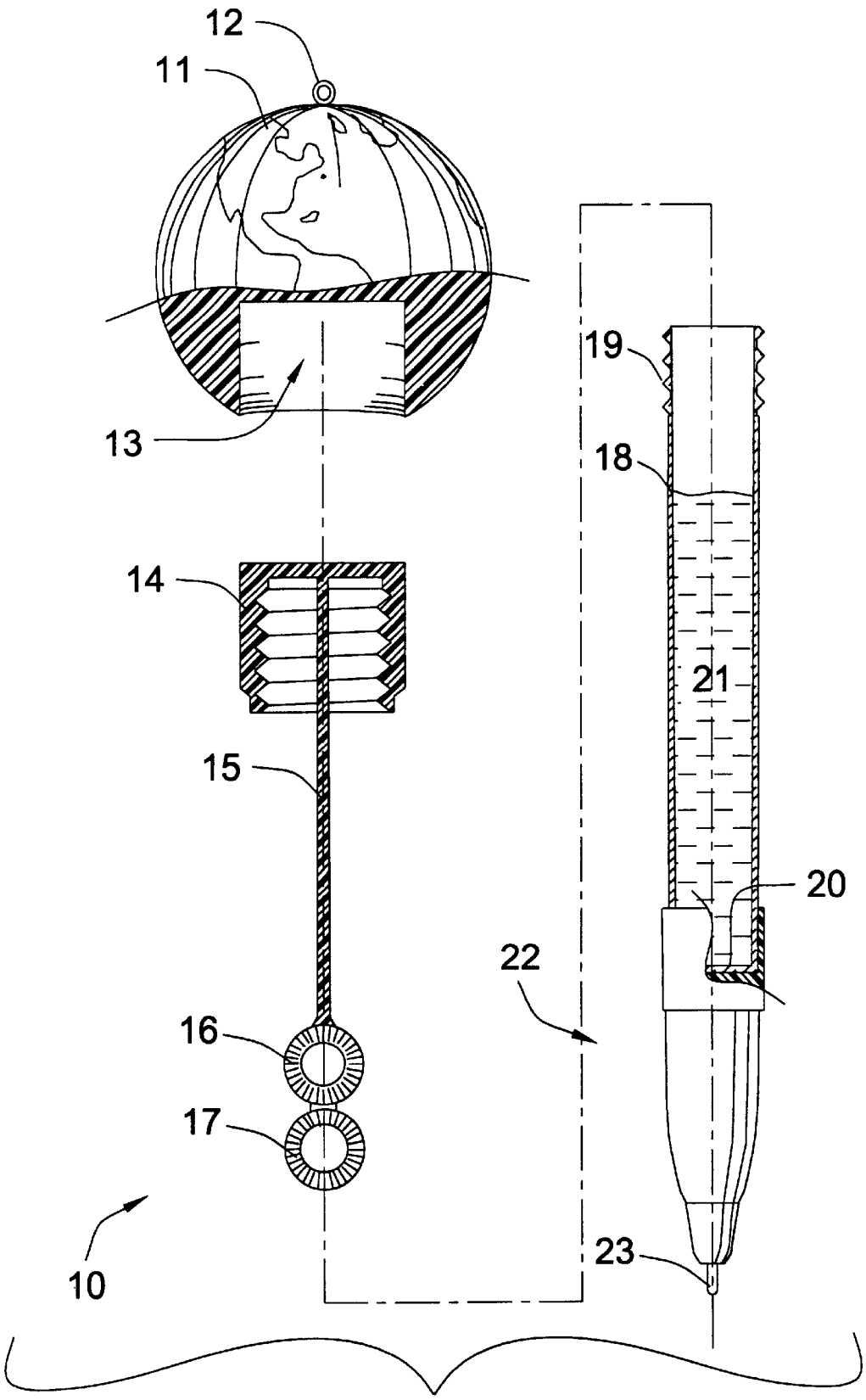
FIG. 3 is an exploded and partially sectioned view of the invention shown in perspective view in FIG. 1.

Reference is now made to FIGS. 1, 2, 3 which when studied together in conjunction with the description that follows will provide a complete understanding of the structural nature of the elastomeric exerciser writing implement and amusement device that embodies the invention.

Turning now to FIG. 1 it will be observed that the perspective of the hand exerciser, writing implement and amusement devise 10 depicted includes the following basic components assembled as shown. Beginning near the top of FIG. 1 there is shown an elastomeric exercise object 11 here being preferably ball shaped and made of any of a number of suitable resilient materials, such as foam rubber or plastic. The exerciser object 11 is provided with a tether ring 12 that has a stem portion not shown that enters the object 11 and is secured therein by any suitable means. While the tether ring does not form a part of the instant invention users of the invention have found it useful on occasion to secure the entire structural arrangement by means of string, thread, wire or chain to a piece of equipment at their work place. Experience has revealed that the popularity of the subject invention has been such that unless the entire structure is secured at a work site the entire unit embodying the invention seems to unexplainably just wander off and never return.

The exerciser ball shaped object 11 as depicted here simulates a globe and includes in a raised relief fashion the major continents or land masses of the planet earth. It is to be understood that the object itself may be designed to carry on the surface thereof any advertising, marking, logo or symbol that may aid in enhancing brand name recognition or is simply attractive.

Immediately beneath the elastomeric object 11 a transparent barrel 18 is shown with a writing implement 22 and its cap 24 completing the bottom end of the structure. The transparent barrel 18 is partially filled with a bubble making solution 21 into which can be seen immersed a bubble wand 15 which terminates at a lower end with bubble rings 16, 17. It is this bubble wand 15 and bubble rings 16, 17 that provide what is termed herein as an amusement device. The operation of the amusement device will be explained in conjunction with a description to FIG. 6 that will follow.

FIG. 2 differs from FIG. 1 in that the writing implement 22 is shown with its writing implement cap removed.

An appreciation of the precise construction of the preferred embodiment of the invention will be apprehended as FIG. 3 is now described. The exerciser ball object 11 is provided with a barrel cap cavity 13 into which internally threaded barrel cap 14 is fitted or secured to the ball 11 in the cavity 13 by any suitable adhesive. No adhesive may be required if the barrel cap 14 has an outside dimension that is slightly larger than the barrel cap cavity 13. The manner in which the transparent barrel 18 and its cap 14 are integrally secured to the ball 15 is illustrative but not critical to the practice of the invention. The cap 14 includes integral therewith the bubble wand 15 previously described. A threaded barrel end 19 cooperated with the internally threaded barrel cap 14 to ensure that the bubble solution 21 does not leak from the barrel 18 when the entire structure is being employed as a writing implement or hand, fingers and forearm exerciser.

The transparent barrel 18 may be made of any suitable material such as plastic. At an end of the barrel 18 remote from the threaded barrel end 19 the barrel 18 is provided with a closed end 20 which may be secured as shown in an upper portion of the writing implement 22. The writing portion of the implement 22 takes the form of an ordinary ball point type pen, the ball tip of which is designated by reference numeral 23.

Figure 6:
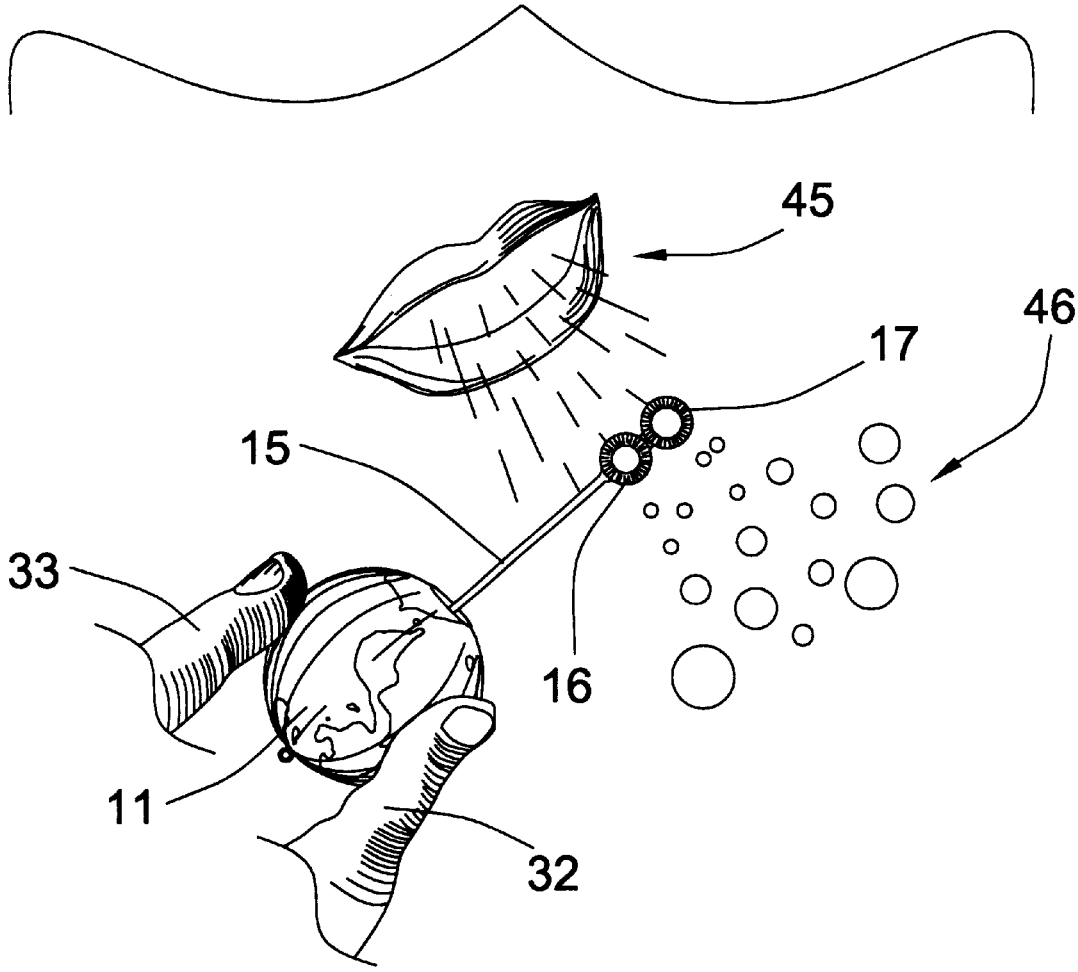
FIG. 6 is a perspective view of a bubble blowing amusement facet of the invention.

We now turn to FIGS. 4, 5 and 6 which illustrate a variety of environments in which the utilitarian nature of the invention finds expression. More specifically in FIG. 4 the elastomeric exerciser ball object writing implement 10 is shown in a writing environment where the writing implement 22 is depicted adjacent a document 30 to be signed. As can be readily seen the users hand 31 is shown with the thumb 32 and index finger 33 gripping the writing implement 10. It will be further appreciated that the overall length of the object 11, barrel 18 and writing implement 22 is such that when the writing implement 22 is grasped as just described and shown in FIG. 4 preparatory to writing a portion of the barrel 18 and all of the object 11 rest upon an upper surface 34 of the hand 31 of the user at a point on the hand where the thumb 32 and index finger 33 join the hand 31. This just described feature of the invention provides support and balance for the object by the hand 31. The nature of this support and balance facilitates the application of thumb and index finger pressure that grip the writing implement during writing activities. If the barrel 18 were made much longer and the object 11 did not rest upon the hand, the weight of the object acting through the barrel to a fulcrum point defined by the barrels contact with the hand would result in a reactive force being experienced in the thumb 32 and index finger 33 and the writer would need to bear down with the thumb 32 and index finger 33 to keep the writing implement 22 and its ball point tip 23 on the document 30.

Reference is now made to FIGS. 5 and 5*a* which depict a left hand 40 of a individual who may be experiencing stress in muscles of the forearm 43 wrist 42 and fingers 41. The illustrations in FIG. 5 and 5*a* are intended to demonstrate a number of ways in which an individual may grasp the elastomeric exercise ball 11. For purposes of illustration only the barrel 18 with its writing implement 22, shown with writing implement cap 24 in place is pictured jutting between an unreferenced middle finger and ring finger of the hand 40. The elastomeric object 11 is indicated by a broken line 47 that here matches the diameter of the ball shaped object 11. The ball object 11 has a diameter that allows the ball to fit between fingers and a palm of the closed hand such that manual gripping and releasing of the ball (see FIG. 5*a*) exercises the hand, fingers and forearm muscles and related ligaments. Many a user reports that this just described gripping and releasing of the ball seems to diminish repetitive stress states in the muscles and ligaments of fingers, hand, wrist and forearm.

FIG. 6 displays the ball object 11 gripped between a thumb 32 and forefinger 33. It should be evident from the foregoing description (See FIGS. 3 and 4) that when the ball object 11 with its internally imbedded cap 14 is rotated free of the threads 19 of the transparent barrel 18, the wand 15 with bubble rings 16, 17 which have been immersed in bubble making solution 21 in the barrel 18 maybe withdrawn. When the wand 15 and bubble rings 16, 17 are removed from the bubble solution 21 there forms a thin film layer of the bubble making solution across openings in the bubble rings 16, 17. In FIG. 6 there is shown schematically a puckered mouth 45 blowing towards the bubble rings to move a body of air therebetween relative to the rings 16, 17 which causes bubbles 46 to appear and float away on ambient air currents. The user may also just wave the ball and wand to produce bubbles. To the question does this bubble making activity actually amuse and entertain the user, one need only watch and see that it is rare indeed for an individual using the bubble making capacity of the invention to try only one personal demonstration of bubble making.

It should be understood that the hand exerciser, sometimes commonly referred to as a "stress ball" can take other shapes or forms such as familiar household or office objects or geometric figures. Common article shapes like light bulbs, computers, golf clubs, etc. could be formed out of elastomeric material to provide the exerciser object 11.

What is claimed is:

1. An elastomeric hand exerciser and writing implement includes in combination:

an elastomeric shaped object having a dimensional configuration that allows it to fit between fingers and a palm of a closed hand of a user thereby enabling manual gripping and releasing of the object to exercise hand, finger and forearm muscles/ligaments of the user and thereby diminish repetitive stress states of the muscles and ligaments of hand and forearm;

the object having secured thereto at one end thereof an elongated barrel that includes a writing implement integral with the barrel at the other end of the barrel remote from the object to thereby provide an elastomeric hand exercise object and writing implement, and the overall length of the object, barrel and writing implement enabling the writing implement to be grasped by fingers and palm of a hand of a user preparatory to writing, with the barrel and integrally secured exerciser object resting upon an upper surface of the hand of the user at a point on the hand where the thumb and index finger of the user join the hand thereby providing support for the object by the hand of the user to facilitate the application of thumb and index finger pressure that grip the writing implement during writing activities induced by movement of the writing implement by the user fingers and hand;

the elongated barrel being comprised of transparent material and includes therein an amusement device;

the transparent barrel having a cavity therein in which the amusement device is visibly positioned;

said transparent barrel being provided with a removable cap at the end adjacent the object and the object being adapted to accommodate the cap securely therewith, said amusement device in the barrel cavity being secured to the removable cap such that movement of the object and attached cap away from the barrel allows the amusement device to be removed from the barrel along with the elastomeric exerciser, and said amusement device including a wand secured to the cap, the wand having a ring structure that cooperates with a bubble making solution in the barrel that forms a thin film layer of liquid across an opening in the ring structure when the wand and ring structure is removed from the bubble making solution such that the application of a moving body of air relative to the ring and thin film produces bubbles and amuses the user.

2. The hand exerciser and writing implement of claim 1 wherein the object is a ball shape.

3. The hand exerciser and writing implement of claim 2 wherein the ball simulates a globe with raised land masses around its periphery.

* * * * *